US005444757A

United States Patent [19]

Beyerlein et al.

[11] Patent Number: 5,444,757

[45] Date of Patent: Aug. 22, 1995

[54] X-RAY GENERATOR

[75] Inventors: Walter Beyerlein, Bubenreuth; Peter Schweighofer, Nuernberg, both of Germany

[73] Assignee: Siemens Aktiengesellschaft, Munich, Germany

[21] Appl. No.: 213,512

[22] Filed: Mar. 16, 1994

[30] Foreign Application Priority Data

May 4, 1993 [DE] Germany ..... 43 14 710.0
Dec. 22, 1993 [DE] Germany ..... 43 43 930.6

[51] Int. Cl.[6] ..... H05G 1/32
[52] U.S. Cl. ..... 378/101; 378/105
[58] Field of Search ..... 378/101, 103, 105, 106, 378/107

[56] References Cited

U.S. PATENT DOCUMENTS 1,337,885 4/1920 Codidge ..... 336/92
4,070,579 1/1978 Brewster ..... 378/106
5,335,161 8/1994 Pellegrino et al. ..... 363/61

FOREIGN PATENT DOCUMENTS 2007939 5/1979 United Kingdom .

OTHER PUBLICATIONS

"Taschenbuch Elektrotechnik," vol. 6, Systeme der Elektroenergietechnik pp. 357–359. 1982.

*Primary Examiner*—Constantine Hannaher
*Assistant Examiner*—David Vernon Bruce
*Attorney, Agent, or Firm*—Hill, Steadman & Simpson

[57] ABSTRACT

An x-ray generator has a power rectifier connected to a high-frequency inverse rectifier and having a high-voltage transformer supplied by the rectifier. In order to achieve low losses in the operation of the high-voltage transformer with a low internal capacitance, the electrical windings of the high-voltage transformer are provided with an insulation having a thickness which is greater than the thickness which would be required solely to accommodate the maximum voltage load.

5 Claims, 2 Drawing Sheets

X-RAY GENERATOR

BACKGROUND OF THE INVENTION

1. Field of the Invention

The present invention is directed to an x-ray generator of the type having a power rectifier followed by a high-frequency inverse rectifier and having a high-voltage transformer supplied by the rectifier.

2. Description of the Prior Art

In an x-ray generator of the above general type, the high-voltage transformer is operated at frequencies on the order of magnitude of 100 kHz. In order not to unnecessarily load the inverse rectifier with high wattless currents, low losses and a low internal capacitance are desirable. In known x-ray generators of this type, the windings of the high-voltage transformer are insulated with lacquer. The design (thickness) of the insulation ensues on the basis of the anticipated voltages. If a thick wire is employed, a low internal capacitance can be achieved, however, high losses arise due to the skin-effect and other phenomena. If a thin wire is used, however, low losses can be achieved, but an undesirably high internal capacitance is present, and there is a high voltage stress on the insulation because many turns are necessary to form one layer.

SUMMARY OF THE INVENTION

It is an object of the present invention to provide an x-ray generator of the type generally described above, wherein the high-voltage transformer has low losses and a low internal capacitance.

The above object is achieved in accordance with the principles of the present invention by providing the windings of the high-voltage transformer with an insulation having a thickness which is greater than the thickness which would nominally be required solely to accommodate the maximum voltage load.

Instead of using an enameled copper wire having a lacquer thickness of a approximately 10 μm, a wire having a thick insulation of approximately 100 μm or more is employed in accordance with the principles of the present invention. Low losses and a low internal capacitance can be simultaneously achieved in this manner. Additionally, such a wire offers high reliability against damage to the insulation occurring during manufacture. The insulation is preferably composed of thermoplastic material.

DESCRIPTION OF THE PREFERRED EMBODIMENTS

Figure 1:
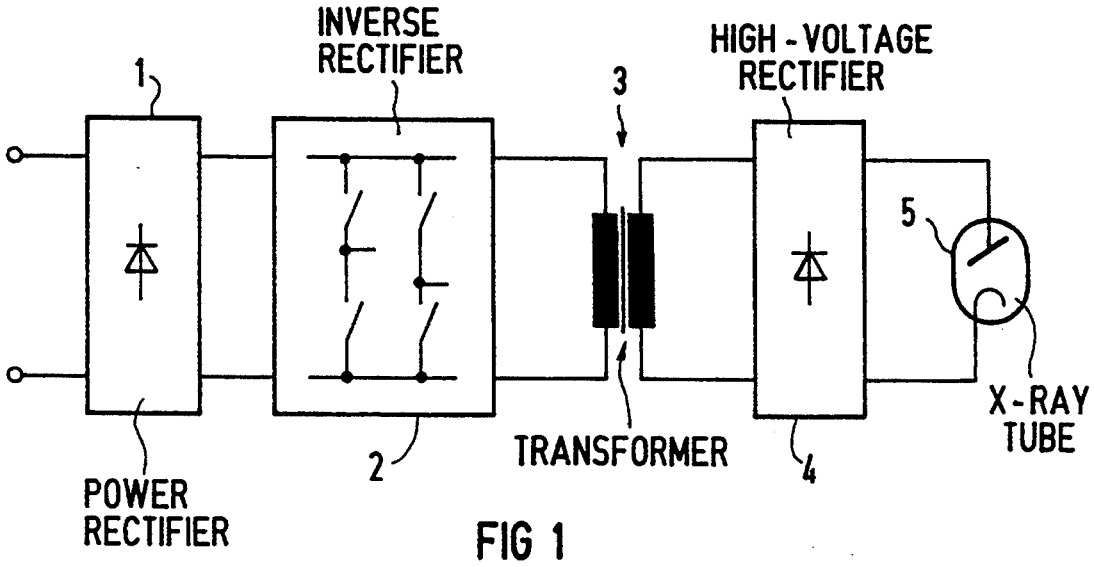
FIG. 1 is a circuit diagram of an x-ray generator constructed in accordance with the principles of the present invention.

The x-ray generator shown in FIG. 1 includes a rectifier 1 fed by the mains voltage, an inverse rectifier 2 operated at a high-frequency, a high-voltage transformer 3 following the inverse rectifier 2, a high-voltage rectifier 4 following the high-voltage transformer 3, and an x-ray tube 5 supplied by the high-voltage rectifier 4.

Figure 2:
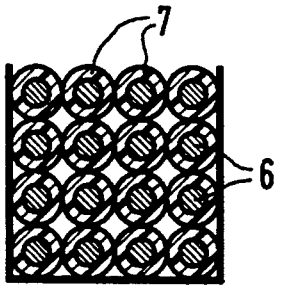
FIG. 2 is shows a portion of the winding of the high-voltage transformer in the x-ray generator according to FIG. 1.

A portion of the windings of the high-voltage transformer 3 are shown in FIG. 2 which, in accordance with the invention, are composed of wires 6 provided with a thick insulation 7. The thick insulation 7 preferably consists of thermoplastic, for example, PTFE.

For example, the wire 6 may have a diameter of 0.25 mm, and the thick insulation 7, consisting of a PTFE insulating layer, may have a thickness of 125 μm. The thickness of the insulation 7 is thus greater by a factor of twelve than the thickness which would be necessary soley to achieve the desired insulating properties. The insulation is selected to have such an increased thickness for reducing proximity losses. The puncture strength of PTFE is in the range of 200–400 kV/cm, and this material has a dielectric constant of 2.2.

Figure 3:
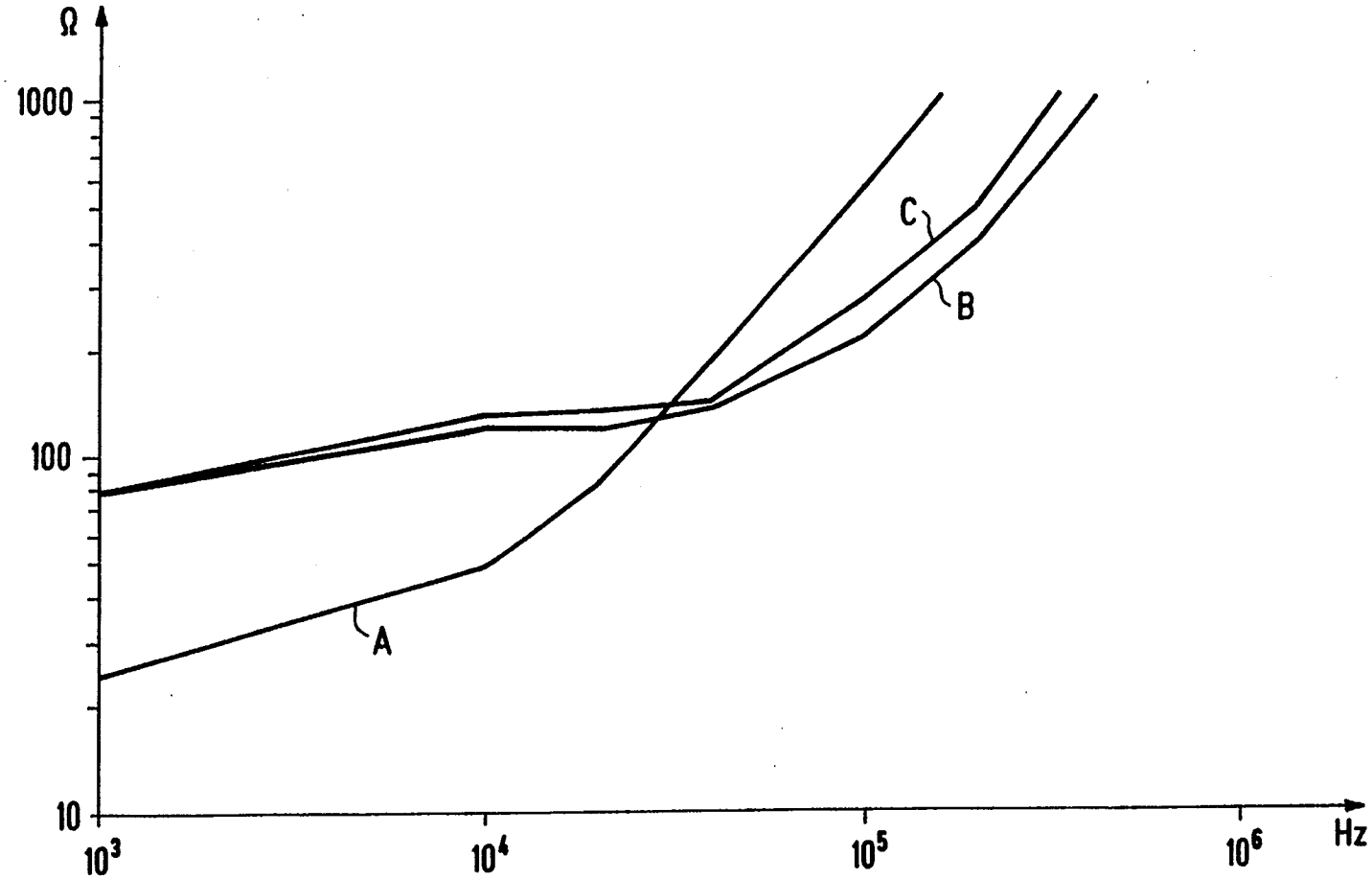
FIG. 3 shows measured curves for explaining the improvement shown in FIG. 2.

Two wires having the same outside diameter are compared in the measured curves of FIG. 3. The resistance in ohms is entered on the vertical axis and the frequency in Hz is entered on the horizontal axis. Wire A is Cu1 0.45 21 with 26.5 μm of lacquer insulation. Wire B is Cu 0.25 with 125 μm PTFE insulation. The two wires A and B have the same outside diameter, and thus an identical winding structure. One can see that the thinner wire B is already superior to the thicker wire A beginning at approximately 30 kHz. Comparison to a normal enameled wire C having a nominal diameter of 0.25 mm and a 22 μm lacquer insulation shows even further improvement. The comparison to the conventional enamel wire C is even more important because a wire having thin lacquer insulation, such as wire C, requires fewer layers because it has a smaller outside diameter, in comparison to wires A and B. According to conventional thinking this would be a condition for achieving a low resistance, however, as can be seen in FIG. 3, wire A exhibits a lower resistance than the conventional wire C in the lower frequency ranges, and wire B exhibits a lower resistance throughout the range of the measured data.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray generator comprising:

a power rectifier connectable to a mains voltage;

a high-frequency inverse rectifier connected following said power rectifier;

an x-ray tube; and a high-voltage transformer connected between said inverse rectifier and said x-ray tube, said high-voltage transformer having windings and exhibiting a maximum voltage load, said windings having an insulation thereon having a thickness which is greater than a thickness required for insulation against said maximum voltage load.

2. An x-ray generator as claimed in claim 1 wherein said windings of said high-voltage transformer include a wire core having a wire diameter, and wherein said insulation has a thickness which is approximately equal to said wire diameter.

3. An x-ray generator as claimed in claim 1 wherein said insulation consists of thermoplastic material.

4. An x-ray generator as claimed in claim 1 wherein said insulation has a thickness which is at least five times greater than said thickness required for insulating against said maximum voltage load.

5. An x-ray generator as claimed in claim 1 wherein said insulation has a thickness greater than 100 μm.

* * * * *